US006153826A

United States Patent [19]

Kenny et al.

[11] Patent Number: 6,153,826

[45] Date of Patent: Nov. 28, 2000

[54] OPTIMIZING LAN CABLE PERFORMANCE

[75] Inventors: Robert D. Kenny, Canton, Mich.; Jim Dickman, Sidney, Nebr.

[73] Assignee: Prestolite Wire Corporation, Port Huron, Mich.

[21] Appl. No.: 09/322,857

[22] Filed: May 28, 1999

[51] Int. Cl.[7] ..... H01B 11/04

[52] U.S. Cl. ..... 174/27; 174/113 R

[58] Field of Search ..... 174/113 R, 121 A, 174/27, 36

[56] References Cited

U.S. PATENT DOCUMENTS

| | | | |
|---|---|---|---|
| 5,010,210 | 4/1991 | Sidi et al. | 174/113 R X |
| 5,399,813 | 3/1995 | McNeill et al. . | |
| 5,424,491 | 6/1995 | Walling et al. . | |
| 5,493,071 | 2/1996 | Newmoyer | 174/113 R |
| 5,564,268 | 10/1996 | Thompson . | |
| 5,576,515 | 11/1996 | Bleich et al. | 174/113 R X |
| 5,597,981 | 1/1997 | Hinoshita et al. . | |
| 5,734,126 | 3/1998 | Siekierka et al. . | |
| 5,744,757 | 4/1998 | Kenny et al. . | |
| 5,770,820 | 6/1998 | Nelson et al. . | |
| 5,814,768 | 9/1998 | Wessels et al. . | |
| 5,821,466 | 10/1998 | Clark et al. . | |

FOREIGN PATENT DOCUMENTS

| | | |
|---|---|---|
| WO 97/39499 | 10/1997 | Sweden . |
| WO 99/00879 | 1/1999 | Sweden . |

*Primary Examiner*—Kristine Kincaid
*Assistant Examiner*—Chau N. Nguyen
*Attorney, Agent, or Firm*—Rader, Fishman & Grauer PLLC

[57] ABSTRACT

A method of constructing twisted pair cables having an average impedance of no less than 97.5Ω and no more than 102.5Ω is disclosed. The longest lay length pair is used as a base reference and the construction of each additional twisted pair is altered to better match the averaged impedance. Specifically, the insulated conductor thickness $T_i$ of each twisted pair is adjusted, dependent upon the configuration of the base pair.

11 Claims, 4 Drawing Sheets

OPTIMIZING LAN CABLE PERFORMANCE

FIELD OF THE INVENTION

The present invention relates to a cable made of twisted wire pairs. More particularly, this invention relates to a twisted pair communications cable designed for use in high-speed data communications applications.

BACKGROUND OF THE INVENTION

A twisted pair cable includes at least one pair of insulated conductors twisted about each other to form a two-conductor group. When more than one twisted pair group is bunched or cabled together, it is referred to as a multi-pair cable. In certain communications applications using a multi-pair cable, such as in high speed data transmission, problems are encountered if the signal transmitted in one twisted pair arrives at its destination at a different time than the signal transmitted at the same time by another twisted pair in the cable. In addition, when two or more wire pairs of different impedance are coupled together to form a transmission channel, part of any signal transmitted thereby will be reflected back to the point of attachment. Reflection due to impedance mismatch between twisted pairs bundled as a multi-pair cable results in undesired signal loss and unwanted transmission errors, greatly compromising the speed of data transmission.

To counteract electrical coupling (i.e. "crosstalk") between twisted pairs of wires bundled as a multi-pair cable, it is known to bundle the twisted pairs wherein each pair within the multi-pair cable requires a different distance, called a "twist lay length", to completely rotate about its central axis. Twist lay length also affects impedance, by affecting both the capacitance and inductance of the cable. Inductance is proportional to the distance between paired conductors taken along the lengths of the conductors, while capacitance in a cable is partially dependent upon the length of the cable. As may be appreciated, when a cable is constructed with small twist lay lengths to its twisted pairs, and the twist lay lengths differ from pair to pair within the multi-pair cable in order to minimize crosstalk, the changes in twist lay length from pair to pair are accompanied by large variations in the physical spacing between individual wires within the pair, thereby affecting inductance. Moreover, if every pair includes a different twist lay length, then the helical lengths of each pair of conductors vary widely, thereby affecting capacitance.

Impedance matching within a given multi-pair cable is critical to achieving high-speed data transmission. However, because the inductance and capacitance changes from pair to pair within a given multi-pair cable, a nominal characteristic or "averaged" impedance may be uncontrolled from pair to pair. In fact, within all cables heretofore known, there is a tendency for the averaged impedance of at least some pairs within a multi-pair cable, where the pairs all have small but different twist lay lengths, to be at or beyond an industry acceptable value.

Currently, the industry accepted value (based upon TIA/EIA 568A-1) for averaged impedance between twisted pairs is 100 ohms, plus or minus 15% (100Ω±15Ω). For example, in a four-pair multi-pair cable, each of the four pairs must have an average impedance within the industry-accepted values. Thus, impedance between pairs may vary by up to 30Ω, or by about 27%.

As data transmission speeds have approached the gigabyte per second level, now achievable due to recent advances in various communications technologies, the variation between twisted pair averaged impedance within a multi-pair cable has been found to greatly affect data transmission performance. Therefore, current industry standards established for lower data transmission speeds are inadequate. Instead, at these required data flow levels, actual transmission speed is only achieved when averaged impedance variation is no less than 97.5Ω and no greater than 102.5Ω (100Ω±2.5Ω).

Thus, numerous attempts have been made within the industry to minimize differences between twisted pair averaged impedance within a multi-pair cable, at best by experimentally altering the insulation thickness. In one attempt, a cable is constructed having multiple twisted pairs divided into two groups of twisted pairs. The insulation thickness of the two groups is empirically optimized to a set value within each group of twisted pairs, and each twisted pair has a different twist lay length. However, even a minor modification often requires extensive and time-consuming additional experimentation to find an acceptable cable construction to accommodate the modification.

In another attempt to minimize averaged impedance, the wires within a twisted pair are joined along their length, thereby limiting an average center-to-center distance between wires within a twisted pair along its length in an attempt to limit inductance effects. Other methods also attempt to modify a single physical property between the twisted pairs, including by modifying the chemical composition of the insulating material, providing special chemical additives to the insulating material, and by adjusting both insulation thickness and insulation density.

SUMMARY OF THE INVENTION

The present invention is directed to a method of constructing twisted pair cables having an average impedance of no less than 97.5Ω and no more than 102.5Ω (100Ω±2.5Ω). In particular, the method of the present invention focuses on designing and constructing multi-pair cable from a plurality of twisted pairs wherein each twisted pair has a different twist lay length.

According to the method of the present invention, the longest lay length pair is used as the base reference and the construction of each additional twisted pair is altered to better match the averaged impedance. Specifically, the insulated conductor thickness $T_i$ of each twisted pair is determined from the following relationship:

$$T_i = XY_i^{1/Z},$$

where

X=insulation thickness of the longest twist lay length pair;

$Y_i$=the twist ratio of the $i^{th}$ pair; and where $2 \leqq Z \leqq 10$.

The twist ratio Yi found as follows:

$$Y_i = \frac{L}{L_i},$$

where

L=the twist lay length, measured in inches, of the longest twist lay length pair; and Li=the twist lay length, measured in inches, of the $i^{th}$ twist lay length pair.

Design and construction of a multi-pair cable according to the present invention recognizes that average impedance is a very important physical characteristic of the cable. By maintaining average impedance between 97.5Ω and 102.5Ω, network throughput is maximized, while data mismatch problems are significantly reduced.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF PREFERRED EMBODIMENTS

Figure 1:
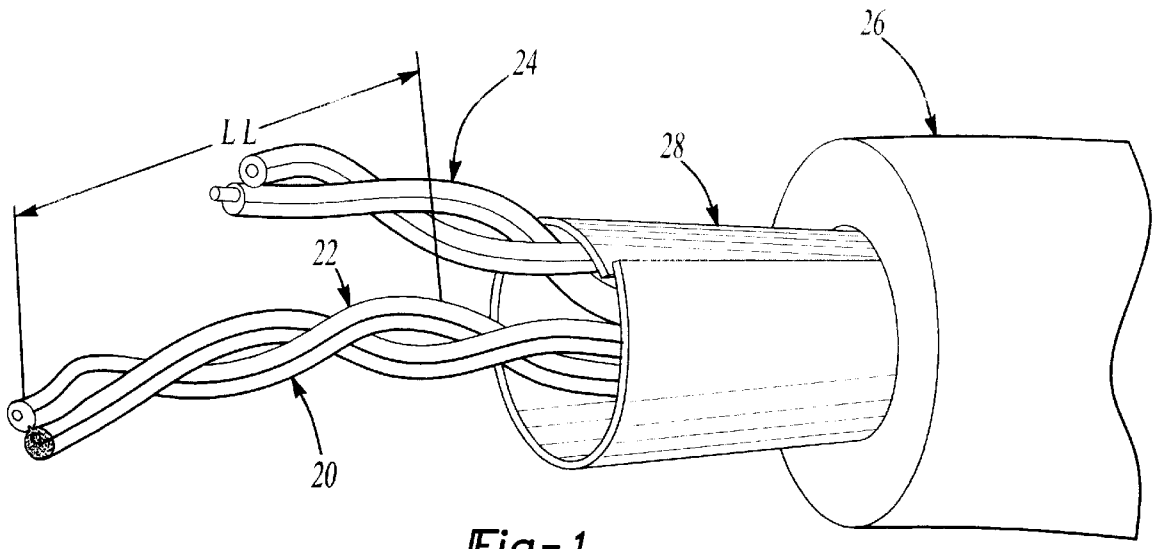
FIG. 1 is a cutaway perspective view of a communications cable.

With reference to FIG. 1, so-called category 5 wiring of the type used for Local Area Networks (LANs) typically comprises a plurality of twisted pairs 20 of insulated conductors. In FIG. 1, only two pairs 22, 24 are shown encased by a jacket 26. Most typically, category 5 wiring consists of 4 individually twisted pairs, though the wiring may include greater or fewer pairs as required. For example, wiring is often constructed with 9 or 25 twisted pairs. The twisted pairs may optionally be wrapped in foil shielding 28, but twisted pair technology is such that most often the shielding 28 is omitted.

Figure 2:
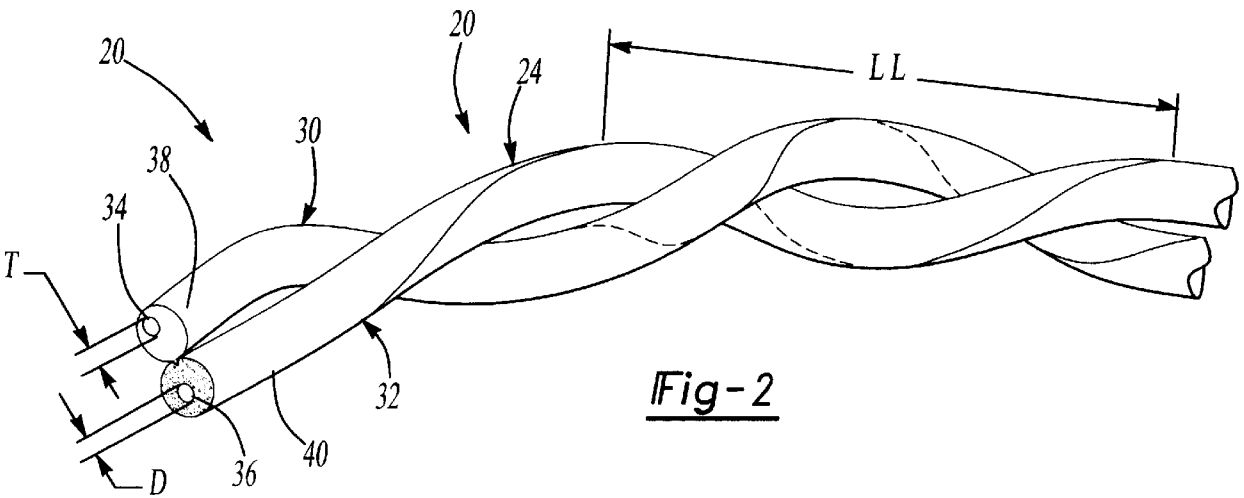
FIG. 2 is an isolation view of a single twisted pair of wires.

Each twisted pair, shown in FIG. 2, includes a pair of wires 30, 32. Each wire 30, 32 includes a respective central conductor 34, 36. The central conductors 34, 36 may be solid metal, a plurality of metal strands, an appropriate fiberglass conductor, a layered metal, or a combination thereof. Each central conductor 34, 36 is surrounded by a corresponding layer 38, 40 of dielectric or insulative material. The diameter D of the central conductors 34, 36, expressed in AWG size, is typically between about 18 to about 40 AWG, while the insulation thickness T is typically expressed in inches (or other suitable units). The insulative or dielectric material may be any commercially available dielectric material, such as polyvinyl chloride, polyethylene, polypropolylene or fluoro-copolymers (like Teflon®) and polyolefin. The insulation may be fire resistant as necessary. To reduce electrical coupling or crosstalk between the wires that comprise a pair, it is known to form each twisted pair within the cable to have a unique twist lay length LL. Twist lay length LL is defined as the amount of distance required for the pair of insulated conductors to completely rotate about a central axis. The insulation thickness T and the central conductor diameter D combine to define an insulated conductor thickness $T_i$. As can be appreciated, the insulated conductor thickness $T_i$ may be increased or decreased by changing the value of T, D or both.

The signal attenuation in the insulated conductors is partly dependent upon the length of the conductors and also upon the distance between them. As a result, if over a unitary length of cable the twist lay length of one pair is smaller than for other pairs, then each conductor length in the short twist lay length pair is longer than in the other pairs. Thus, the short twist lay length pair tends to attenuate a data transmission signal more than the other pairs. Moreover, those conductors with the shorter twist lay length tend to be crushed closer together than other pairs, thereby bringing the conductors within the pair closer together. In fact, as the two insulated conductors are twisted together, the insulated conductor thickness $T_I$. may be reduced due to the tightness of the twist, thereby reducing the distance between the central conductors. Undesirably, reducing the center-to-center distance between the conductors also increases the attenuation, while at the same time lowering the impedance. In fact, the impedance decreases rapidly from pair to pair as the twist lay length becomes shorter.

Thus, the twist lay length LL affects the averaged impedance of each pair of insulated conductors, and the longer the twist lay length LL, the higher the impedance.

Figure 3:
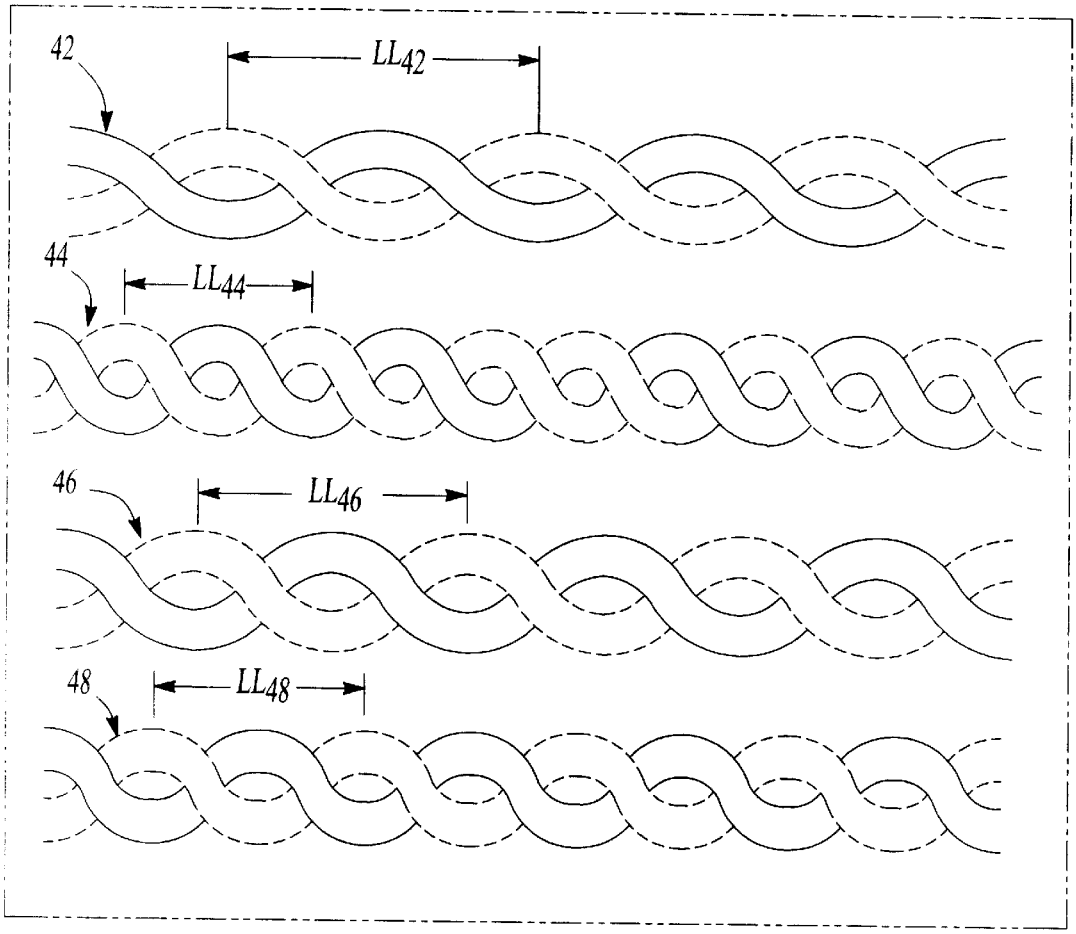
FIG. 3 is an exploded side view of four twisted pairs that comprise a first embodiment of the invention.
Figure 4:
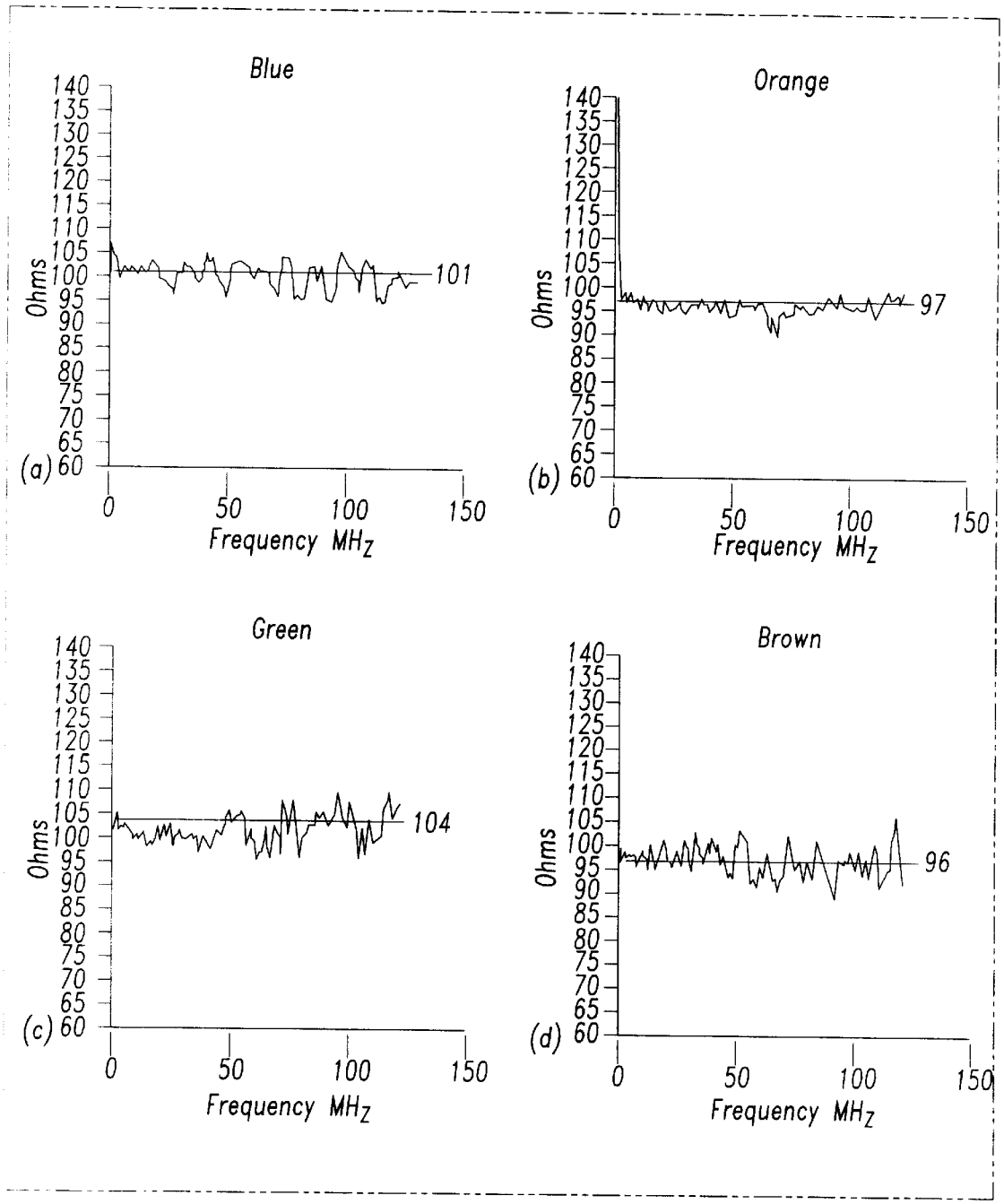
FIGS. 4*a*–4*d* show average impedance of the wires of FIG. 3 before application of the present invention.
Figure 5:
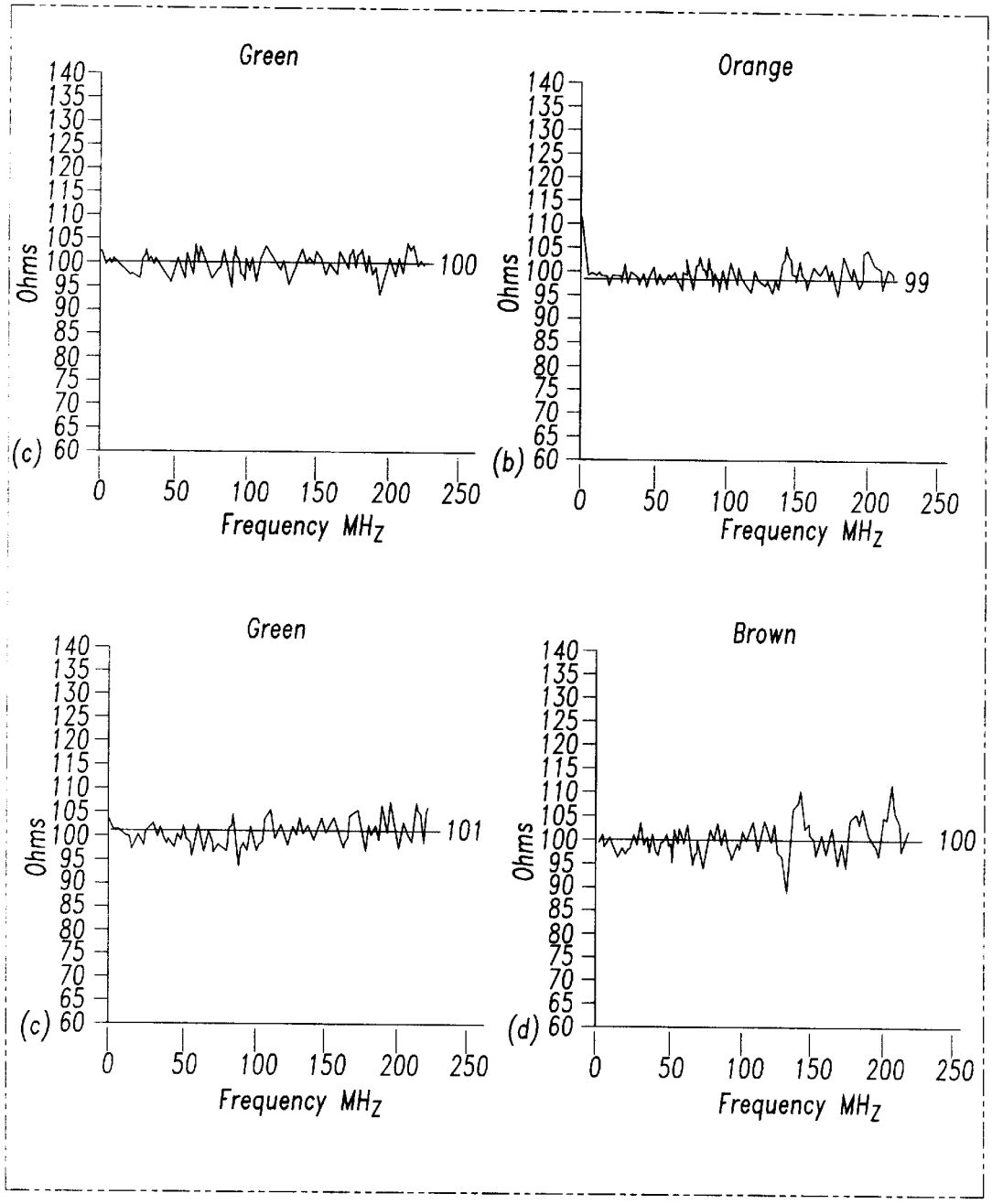
FIGS. 5*a*–5*d* show average impedance of the wires of FIG. 3 after the application of the present invention.

FIG. 3 shows an example of four twisted pairs 42, 44, 46 and 48 that may comprise an unshielded twisted pair cable. As discussed above, to decrease coupling, or crosstalk, between the pairs, each twisted pair is formed with a different twist lay length. Under ordinary cable construction methods, the fact that conductor pairs 42, 44, 46 and 48 include different twist lay lengths means that the averaged impedance between the two conductors differs. In particular, inductance and capacitance, two factors that influence average impedance, vary between twisted pairs of different twist lay lengths. The present invention counteracts the effect of twist lay length on average impedance, thereby minimizing the average impedance and significantly improving network throughput.

According to the present invention, the longest lay length pair (reference 42 in FIG. 3) is used as the base reference, and the construction of the other pairs within a given cable is altered to achieve matched impedances. For the purposes of illustration only, it will be assumed hereinafter that a cable having four twisted pairs is to be constructed utilizing the inventive method. However, it should be understood that the present inventive method may be applied to cables comprising any number of twisted pairs to match averaged impedance levels within the cable.

FIGS. 4*a*–4*d* show measured averaged impedance of the wires of FIG. 3 before application of the present invention for purposes of illustrating the effect of twist lay length on impedance. In FIGS. 4*a*–4*d*, impedance (in Ω) is plotted as a function of frequency (in MHz) for each of the pairs shown in FIG. 3, assuming that each pair include 24 AWG conductors having the twist lay lengths as indicated in column 2 of Table 1. The measured average impedance values are shown in column 4 of Table 1.

TABLE 1

Average impedance is shown as a function of twist lay length.

| Ref. Number | Twist Lay Length (in.) | FIG. Number | Average Impedance (Ω) |
|---|---|---|---|
| 42 | 0.87 | 3c | 104 |
| 46 | 0.74 | 3d | 101 |
| 48 | 0.58 | 3b | 97 |
| 44 | 0.49 | 3a | 96 |

The cable described in FIGS. 4*a*–4*d* and in Table 1 technically meets the industry-accepted standard set forth in TIA/EIA 568A-1 for averaged impedance. As noted above, the industry accepted standard requires averaged impedance within a multi-pair cable to be 100 ohms, plus or minus 15% (100Ω±15Ω). As shown in FIG. 4 and in Table 1, the industry standard is relatively easy to meet simply by varying the twist lay lengths. However, for multi-pair cables including more than four twisted pairs, it becomes progressively more difficult to match averaged impedance values for larger numbers of pairs where each pair has a unique twist lay length.

Moreover, it has been found that the industry accepted standard (100Ω±15Ω) is not stringent enough, especially as applied to extremely high speed data transmission cables (i.e. gigabyte per second or greater). As applied to gigabyte per second data transmission cables (and even slower speed transmission cables), small variations between twisted pair averaged impedance within a multi-pair cable will greatly affect data transmission performance. The present invention may be used to optimize transmission levels in all cables, but especially in cables reaching the gigabyte per second transmission speeds.

It has been found that network performance is optimized when averaged impedance between pairs in a multi-pair cable is no less than 97.5Ω and no greater than 102.5Ω (100Ω±2.5Ω). Rather than empirically determine the physical properties of each twisted pair having a unique twist lay length, it has been discovered that, by meeting the following relationships, a multi-pair cable may be constructed including unique twist lay lengths between each twisted pair having an averaged impedance of 100Ω±2.5Ω.

Specifically, the insulated conductor thickness $T_i$ of each twisted pair is found as a function of the insulation thickness of the longest twist lay length pair in the multi-pair cable as follows:

$$T_i = XY_i^{1/Z}, \tag{1}$$

where

X=insulation thickness of the longest twist lay length pair;

$Y_i$=the twist ratio of the $i^{th}$ pair; and where $2 \leqq Z \leqq 10$.

As noted, the value of Z may be between 2 and 10, inclusive, but most preferably, Z lies between 3 and 5, inclusive. In addition, the insulated conductor thickness may be adjusted by increasing the diameter D of the central conductor, and correspondingly decreasing the insulation thickness of the longest twist lay length.

The twist ratio $Y_i$ is found as follows:

$$Y_i = \frac{L}{L_i}, \tag{2}$$

where

L=the twist lay length, measured in inches, of the longest twist lay length pair; and $L_i$=the twist lay length, measured in inches, of the $i^{th}$ twist lay length pair.

EXAMPLE 1

Given the twist lay lengths of the pairs as described above in Table 1, if the insulated conductor thickness of pair 42 is 0.0065 inches, what insulated conductor thicknesses for pairs 44, 46 and 48 would optimize network performance and maintain averaged impedance of 100Ω±2.5Ω?

Pair 42 has the longest twist lay length, so pair 42 becomes the base reference. As a first step, twist lay length ratios must be determined according to Equation 2:

$$Y_{46} = \frac{0.87''}{0.74''} = 1.176; \tag{3}$$

$$Y_{48} = \frac{0.87''}{0.58''} = 1.5; \tag{4}$$

$$Y_{44} = \frac{0.87''}{0.49''} = 1.776. \tag{5}$$

Applying a midrange Z value of 4 to Equation 1 produces the following:

$$T_{46} = (0.0065) \cdot Y_{46}^{1/4} = 0.0068'' \tag{6}$$

$$T_{48} = (0.0065) \cdot Y_{48}^{1/4} = 0.0072'' \tag{7}$$

$$T_{44} = (0.0065) \cdot Y_{44}^{1/4} = 0.0075'' \tag{8}$$

FIGS. 5*a*–5*d* show measured averaged impedance of the wires constructed according to Example 1. In FIGS. 5*a*–5*d*, impedance (in Ω) is plotted as a function of frequency (in MHz) for each of the pairs constructed as in Example 1. The measured average impedance values are shown in column 4 of Table 2.

TABLE 2

Average impedance of the wires constructed in accordance with the present invention as calculated in Example 1.

| Ref. Number | Twist Lay Length (in.) | FIG. Number | Average Impedance (Ω) |
|---|---|---|---|
| 42 | 0.87 | 4c | 101 |
| 46 | 0.74 | 4d | 100 |
| 48 | 0.58 | 4b | 99 |
| 44 | 0.49 | 4a | 100 |

As seen in FIGS. 5*a*–5*d*, the average impedance over the entire spectrum of expected frequencies is easily maintained within the target of 100Ω±2.5Ω. Thus, by applying equations 1 and 2 to shielded and unshielded cables having any number of twisted pairs, each with a unique twist lay length, average impedance may be predicted. Design of a high performance multiple pair cable is therefore as simple as designing a first twisted pair having a desired impedance, and then applying the inventive method to as many additional twisted pairs as desired.

Design and construction of a multi-pair cable according to the present invention recognizes that average impedance is a very important physical characteristic of the cable. Multi-pair cables constructed according to the invention maintain the average impedance of the final product to no less than 97.5Ω and no more than 102.5Ω (100Ω±2.5Ω). By maintaining average impedance between 97.5Ω and 102.5Ω, network throughput is maximized, while data mismatch problems are significantly reduced.

Preferred embodiments of the present invention have been disclosed. A person of ordinary skill in the art will realize, however, that certain modifications and alternative forms will come within the teachings of this invention. Therefore, the following claims should be studied to determine the true scope and content of the invention.

What is claimed is:

1. A method of designing a data transmission cable having at least three twisted pairs, each twisted pair having a unique twist lay length, comprising:

identifying the unique twist lay length of each twisted pair;

identifying the insulated conductor thickness of the twisted pair having the longest lay length; and determining different insulated conductor thicknesses of each remaining twisted pair solely as a function of the longest lay length to limit variation of average impedance between the twisted pairs.

2. A method as recited in claim 1, wherein the remaining conductor thicknesses are determined according to the following relationship:

$$T_i = XY_i^{1/Z},$$

where

X=insulation thickness of the longest twist lay length pair;

$Y_i$=the twist ratio of the $i^{th}$ twist pair;

where $2 \leqq Z \leqq 10$; and where the twist ratio $Y_i$ is found as follows:

$$Y_i = \frac{L}{L_i},$$

where

L=the twist lay length, measured in inches, of the longest twist lay length pair; and $L_i$=the twist lay length, measured in inches, of the $i^{th}$ twist lay length pair.

3. The method of claim 2, wherein Z has a value of between 3 and 5, inclusive.

4. The method of claim 2, wherein the variation of average impedance between the pairs is approximately three percent.

5. The method of claim 4, wherein the average impedance is 100Ω and the variation of average impedance is ±2.5Ω.

6. The method of claim 3, wherein i=4.

7. The method of claim 2, wherein i=4.

8. A data transmission cable, comprising:

at least three twisted pairs, each twisted pair having a unique twist lay length and a unique insulated conductor thickness, wherein a determination of said unique insulation conductor thickness for each twisted pair is predetermined solely as a function of the longest twist lay length to limit variation of average impedance between said twisted pairs.

9. A data transmission cable as recited in claim 8, wherein said function obeys the following relationship:

$$T_i XY_i^{1/Z},$$

where

X=insulation thickness of the longest twist lay length pair;

$Y_i$=the twist ratio of the $i^{th}$ pair;

where $2<Z<10$; and where the twist ratio $Y_i$ is found as follows:

$$Y_i = \frac{L}{L_i},$$

where

L=the twist lay length, measured in inches, of the longest twist lay length pair; and $L_i$=the twist lay length, measured in inches, of the $i^{th}$ twist lay length pair.

10. A data transmission cable as recited in claim 9, wherein said variation of average impedance is limited to approximately three percent.

11. The method of claim 10, wherein the average impedance is 100Ω and the variation of average impedance is ±2.5Ω.

* * * * *

UNITED STATES PATENT AND TRADEMARK OFFICE

CERTIFICATE OF CORRECTION

PATENT NO. : 6,153,826
DATED : November 28, 2000
INVENTOR(S) : Robert D. Kenny, et al.

It is certified that error appears in the above-identified patent and that said Letters Patent is hereby corrected as shown below:

Column8,
Line 4, replace "insulation" with -- insulated --.

Signed and Sealed this

Twenty fifth Day of September, 2001

*Attest:*

Nicholas P. Godici

NICHOLAS P. GODICI
*Acting Director of the United States Patent and Trademark Office*

*Attesting Officer*